US005279505A

United States Patent [19]

Goudreau et al.

[11] Patent Number: 5,279,505

[45] Date of Patent: Jan. 18, 1994

[54] APPARATUS FOR SECURELY ATTACHING A CASING TO A PERSON

[75] Inventors: Noel Goudreau; Michael E. Reeves, both of Bourbonnais, Ill.

[73] Assignee: Comguard, Inc., Bourbonnais, Ill.

[21] Appl. No.: 970,014

[22] Filed: Nov. 2, 1992

[51] Int. Cl.[5] ..... H01R 33/00

[52] U.S. Cl. ..... 439/37; 24/573.1; 24/625; 24/704.1

[58] Field of Search ..... 439/37; 24/704.1, 704.2, 24/625, 573.1; 340/573; 455/344, 347, 100

[56] References Cited

U.S. PATENT DOCUMENTS 3,478,344 11/1969 Schwitzgebel et al. .
3,810,146 5/1974 Lieb .
4,559,679 12/1985 Downey ..... 24/573.1 X
4,736,196 4/1988 McMahon ..... 340/573
4,918,432 4/1990 Pauley et al. .
4,952,913 8/1990 Pauley et al. .
4,952,928 8/1990 Carroll et al. .
4,970,671 12/1990 McCurdy .
4,999,613 3/1991 Williamson et al. .

*Primary Examiner*—Eugene F. Desmond

*Attorney, Agent, or Firm*—Wood, Phillips, VanSanten, Hoffman & Ertel

[57] ABSTRACT

Apparatus for securely attaching a casing to a person includes an elongate strap and a strap connector having a male retainer at an end thereof. The strap connector has a female retainer at an opposite end thereof. A casing defines first and second openings connected by a passageway. The female retainer is snap-fit to the casing in the passageway of the casing through the first opening. The male retainer is snap-fit to the female retainer in the passageway through the second opening.

18 Claims, 3 Drawing Sheets

APPARATUS FOR SECURELY ATTACHING A CASING TO A PERSON

FIELD OF THE INVENTION

This invention relates to apparatus for securely attaching a casing to a person, and, more particularly to apparatus including an elongate strap having a female retainer at an end thereof and a male retainer at an opposite end thereof, wherein the male and female retainers are snap-fit together inside the casing.

BACKGROUND OF THE INVENTION

It is often desirable to secure a casing to a person. For example, in a home incarceration system, it is desirable to secure a bracelet (or anklet) including a casing, as for an identifying device or circuit, to an incarceree. Periodically, a central station initiates a call to the incarceree's home or other designated location. The incarceree responds by coupling the identifying circuit in the casing with a decoder. The decoder responds to the identifying circuit to verify that the incarceree is at the incarceree's home, and transmits a verification signal to the central station.

Other systems include a transmitter mounted in the casing. If the incarceree goes outside of the limiting range of the transmitter, the transmitter signal has insufficient power to reach a base station at the incarceree's home and the base station initiates contact with the central station to indicate that the incarceree has left the limiting range. Such bracelets can include a conductor threaded through an elongate strap which activates or deactivates the transmitter if broken.

For proper operation of a home incarceration, the incarceree must not be able to remove the bracelet or anklet without being detected either by a physical inspection of the bracelet or by electronic contact with the central station.

SUMMARY OF THE INVENTION

Apparatus for securely attaching a casing to a person includes an elongate strap and a strap connector having a male retainer at an end thereof. The strap connector has a female retainer at an opposite end thereof. A casing defines first and second openings connected by a passageway. The female retainer is snap-fit to the casing in the passageway of the casing through the first opening. The male retainer is snap-fit to the female retainer in the passageway through the second opening.

It is a feature of the invention that the elongate strap includes a first connector at the end for connecting the male retainer and a second connector at the opposite end for connecting the female retainer.

It is a further feature of the invention that the first connector lies inside the passageway when the female retainer is snap-fit to the casing.

In another feature of the invention, the female retainer includes a base and the first snap-fitting means on the female retainer includes first and second spaced cantilevered arms extending from the base wherein the first and second cantilevered arms each include an outwardly-facing projection at a distal end thereof.

In yet another feature of the invention, the first snap-fitting means on the casing includes first and second C-shaped walls in the passageway and the casing includes a means for engaging the base when the female retainer is fully inserted.

Other objects and features will be readily apparent.

DETAILED DESCRIPTION OF THE INVENTION

Figure 1:
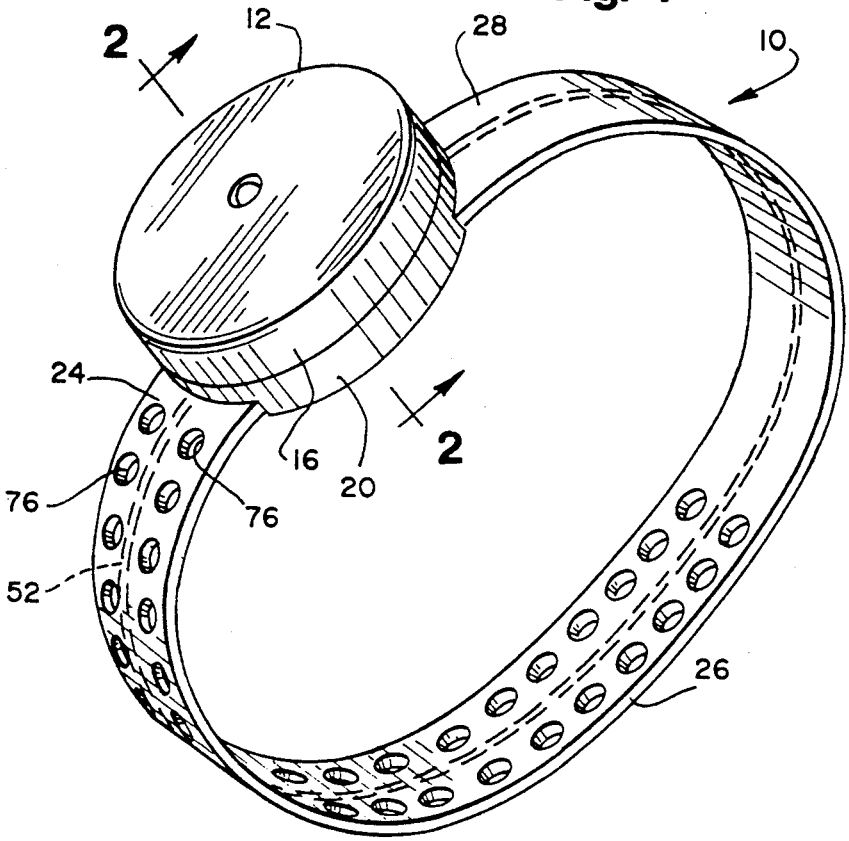
FIG. 1 is a perspective view of a casing including an upper and lower housing and an elongate strap.

FIG. 1 shows apparatus 10 for securely attaching a casing 12 to a person. The casing 12 can include an upper housing 16 attached to a lower housing 20. One-piece or multiple-piece casings 12 are also contemplated. An end 24 of an elongate strap 26 is connectable to one side of the lower housing 20. An opposite end 28 of the elongate strap 26 is wrapped around a person's wrist or ankle and connected to the other side of the lower housing 20. The length of the strap 26 is chosen to fit snugly over the wrist or the ankle of the person.

Figure 2:
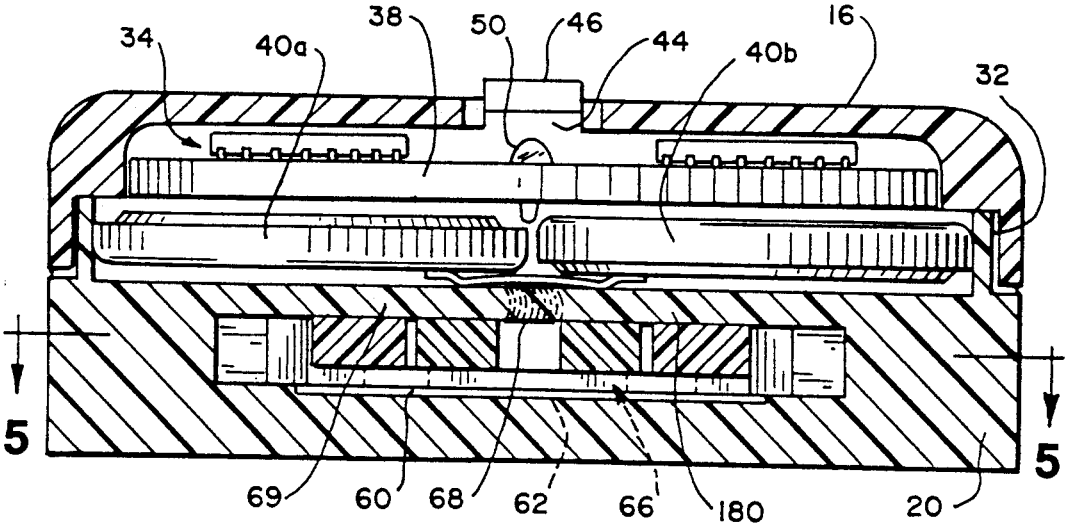
FIG. 2 is a sectional view of the casing of FIG. 1 and taken along line 2—2 in FIG. 1.

FIG. 2 shows a sectional view of the casing 12 without the elongate strap 26 and taken along line 2—2 in FIG. 1. The upper housing 16 is fused to the lower housing 20 as by a plastic adhesive 32. The upper and lower housings 16,20 define a cavity 34 in which a circuit 38 and batteries **40*a* and 40*b* are housed. The upper housing 16 includes an access hole 44 and a molded lens 46. The access hole 44 and the molded lens 46 allow an infrared signal to pass to and optically couple with diode 50 in the circuit 38. Alternatively, if a material chosen for the upper housing 16 can transmit infrared signals without distorting the infrared signal, the access hole 44 and the lens 46 are not required. A conductor 52 embedded in the elongate strap 26 is connected at both ends thereof to the circuit 38, as will be described below. Preferably, the conductor 52** is a braided wire. Such braided wires have an increased contact area and increased resistance to breakage over single wire conductors.

Other means for connecting the upper and lower housings are contemplated. For example, the upper and lower housing could be fastened together by threads, bonded or melted together. The upper and lower housings 16,20 could be initially secured by threads 32 and then be melted together to prevent access to the circuit 38. A hole 54 (or multiple holes) on the order of 1/32 inches can be drilled in the upper and lower housings 16,20 and glue, for example epoxy, applied inside the hole 54. After the epoxy sets, the epoxy acts like a shear pin and prevents rotation of the upper housing 16 with respect to the lower housing 20. preferably, holes are drilled in the casing above first and second openings 60,62 to avoid drilling into the batteries.

Figure 5:
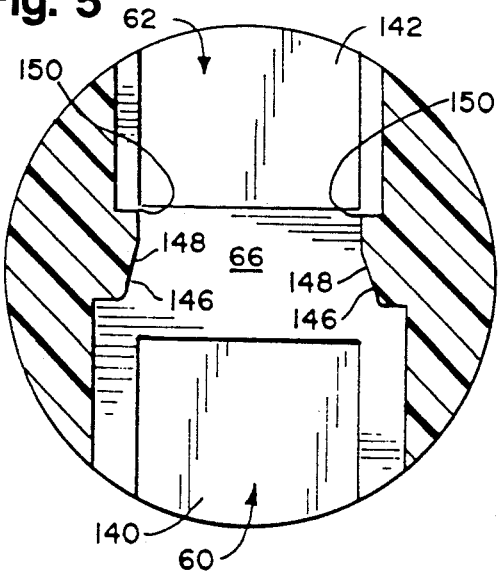
FIG. 5 is a sectional view of the casing taken along line 5—5 in FIG. 2.

The casing 12 defines the first and second openings 60,62 which are connected by a passageway 66, as best seen in FIGS. 2 and 5. A first rectangular conductor 68 (bent into a C-shape after being inserted through a wall 69 on the lower housing 20 which separates the cavity 34 from the passageway 66) connected to the circuit 38 extends from the cavity 34 through the casing 12 and into the passageway 66 adjacent the first opening 60. A second rectangular conductor (not shown) connected to the circuit 38 extends from the cavity 34 through the casing 12 and into the passageway 66 adjacent the second opening 62.

Figure 3A:
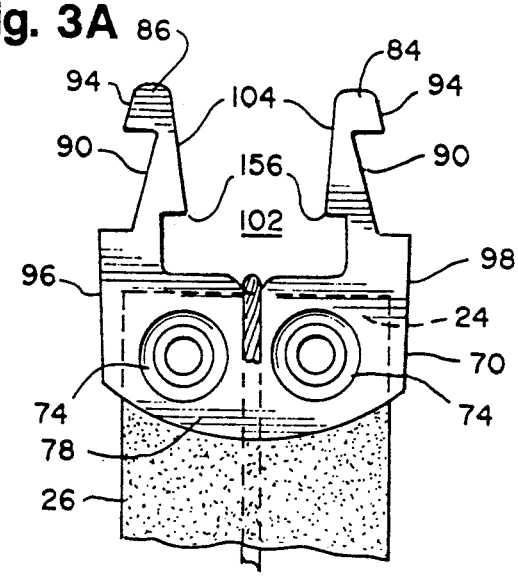
FIG. 3A is a plan view of a female retainer.

FIGS. 3-5 show how the elongate strap 26 can be connected to the casing 12. In FIG. 3A, the end 24 of the elongate strap 26 is connected to a female retainer 70 as by rivets 74, although other connecting means are contemplated. Spaced holes 76 in the end 24 of the elongate strap 26 (as best seen in FIG. 1) allow the length of the strap 26 to be shortened to accommodate for smaller wrists, with the excess strap 26 being cut. Nubs 77 properly space the female retainer 70 inside the passageway 66.

The female retainer 70 includes a base 78 and first and second cantilevered arms 84,86 extending from the base 78. The first and second cantilevered arms 84,86 include outwardly-facing, C-shaped recesses 90 and outwardly-facing projections 94 located at a distal end of the cantilevered arms 84,86. The C-shaped recesses 90 are located between the projections 94 and a proximate end of the cantilevered arms 84,86. An outwardly-facing side of the projections 94 is inclined with respect to first and second sides 96,98 of the female retainer 70. The base 78 and the first and second cantilevered arms 84,86 define a T-shaped recess 102 therebetween. Inwardly-facing sides 104 of the first and second cantilevered arms 84,86 are oppositely inclined with respect to the first and second sides 96,98.

Figure 3B:
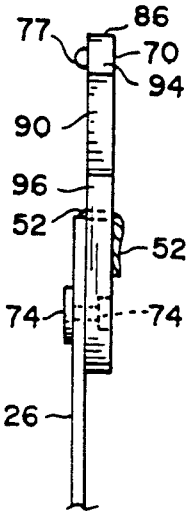
FIG. 3B is a side view of the female retainer of FIG. 3A.

FIG. 3B shows a side view of the female retainer 70. The braided wire 52 extends out the end 24 of the elongate strap 26 to a top of the female retainer. When the female retainer 70 is snap-fit into the first opening 60 of the casing 12, the conductor 52 and the first C-shaped rectangular conductor 68 are connected.

Figure 4A:
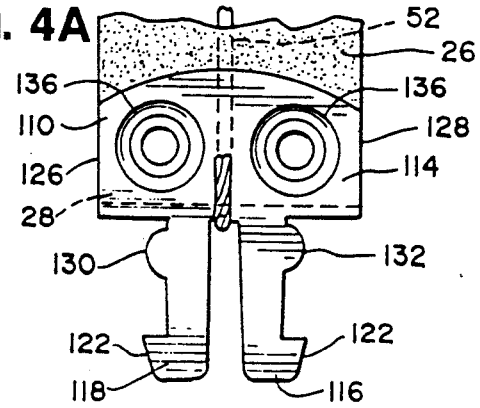
FIG. 4A is a top plan view of a male retainer.

FIG. 4A shows a male retainer 110 including a base 114 and third and fourth cantilevered arms 116,118 extending from the base 114. The third and fourth cantilevered arms 116,118 include outwardly-facing projections 122 which are inclined with respect to first and second sides 126,128 of the male retainer 110. First and second outwardly-facing protuberances 130,132 are located at a proximate end of the third and fourth cantilevered arms 116,118. The opposite end 28 of the elongate strap 26 is connected to the male retainer 110 as by rivets 136. Nubs 137 properly space the male retainer 110 inside the passageway 66.

Figure 4B:
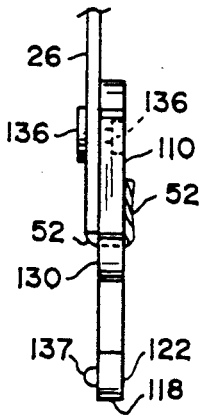
FIG. 4B is a side view of the male retainer of FIG. 4A.

FIG. 4B shows a side view of the male retainer 110. The conductor 52 extends from the end 28 of the elongate strap 26 between the third and fourth cantilevered arms 118,122 to a top of the male connector 110. When the male connector 110 is snap-fit into the second opening 62 of the casing 12, the conductor 52 and the second C-shaped rectangular conductor are connected.

FIG. 5 shows a sectional view taken along lines 5—5 in FIG. 2. The casing 12 defines the first and second openings 60,62 connected by the passageway 66. First and second grooves 140,142 are formed in the first and second openings 60,62, respectively, to provide sufficient clearance for the rivets 74,136 which attach the elongate strap 26 to the female/male retainer 70,110, respectively. C-shaped walls 146 are formed in the passageway and engage the corresponding C-shaped recesses 90 in the female retainer 70. The inclined projections 94 are slidingly received along an inclined surface 148 of the C-shaped walls 146. The inclined surface 148 biases the first and second cantilevered arms 84,86 towards each other.

When the female retainer 70 is fully inserted into the first opening 60, the projections 94 clear a corner 150 of the C-shaped walls 146, and the first and second cantilevered arms 84,86 snap-fit into position with the C-shaped recesses 90 engaging the C-shaped walls 146. After the female retainer 70 has been inserted into the first opening 60 and snap-fit in the passageway 66, the male retainer 110 is inserted through the second opening 62.

The inclined projections 122 on the third and fourth cantilevered arms 116,118 engage the sides 104 on the first and second cantilevered arms 84,86 to bias the third cantilevered arm 116 toward the fourth cantilevered arm 118. As the male retainer 110 is urged further into the second opening 62, the inclined projections 122 clear corners 156 to snap-fit the male retainer 110 inside the second opening 62.

Figure 6:
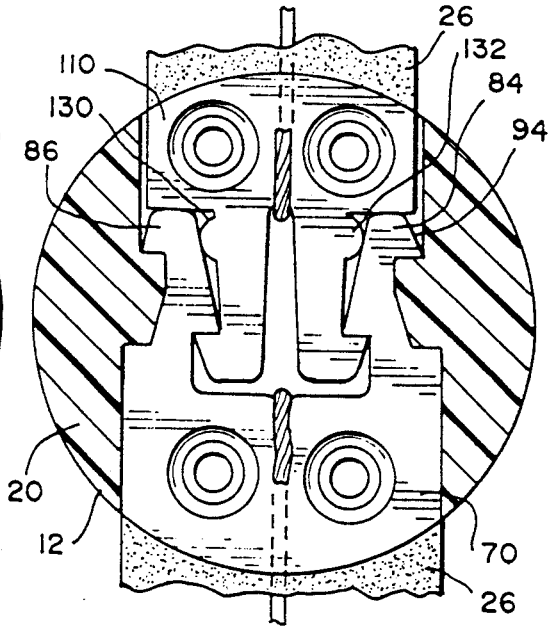
FIG. 6 is a plan view of the female retainer of FIG. 3A and the male retainer of FIG. 4A inserted in the casing of FIG. 5.

FIG. 6 shows FIG. 5 with the female retainer 70 and the male retainer 110 snap-fit in place. The protuberances 130,132 force the projections 94 of the first and second cantilevered arms 84,86 against the C-shaped notches 146 preventing removal of the male or female retainer 70,110.

Figure 8:
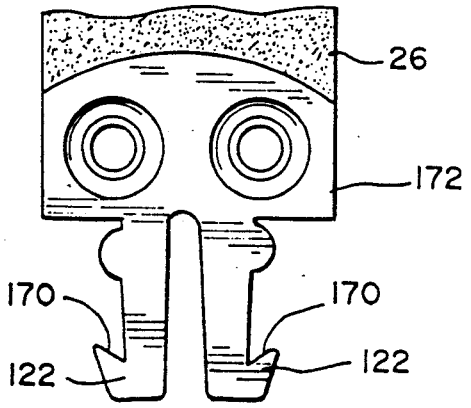
FIG. 8 is a plan view of an alternate male retainer having barbs.
Figure 7:
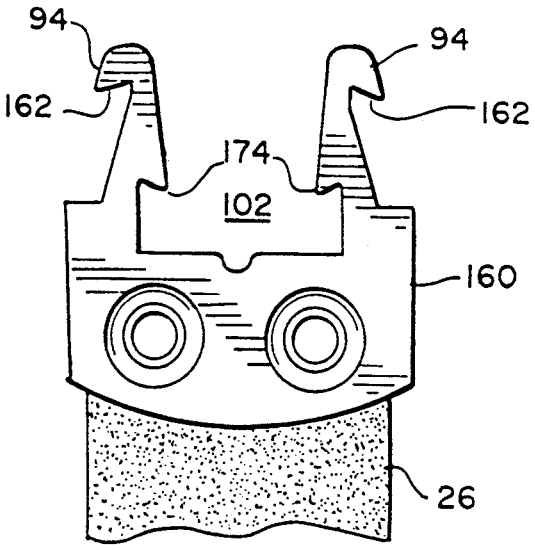
FIG. 7 is a plan view of an alternate female retainer having barbs.

FIG. 7 shows an alternate female retainer 160. The projections 94 include a barb 162. A corresponding barb 166 is formed in the C-shaped walls 146 in the passageway 66. When the barbs 162 on the projections 94 engage the barbs 166 formed on the C-shaped walls 146, a pull-out resistance for the female retainer 160 is greatly increased. The female retainer 160 can also include a notch 168 for holding the braided wire 52 (not shown in FIG. 7) in place. Similarly, barbs 170 on the projections 122 of an alternate male retainer 172 (FIG. 8) engage barbs 174 in the T-shaped recess 102 of the female retainer 160 to increase the pull-out resistance. While barbs 162,166 are shown on the female retainer 116 and the casing 12 in the passageway 66, it can be appreciated that the barbs 162,166 are optional since the first and second cantilevered arms 84,86 are held against the C-shaped walls 146 by the first and second protuberances 130,132 and barbs 162,166 may not appreciably affect the pull-out resistance of the female retainer 160.

Figure 9:
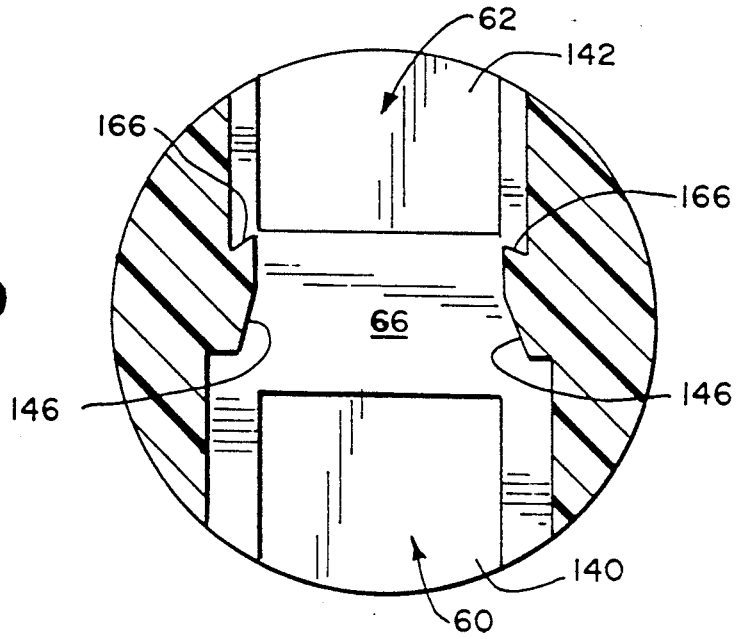
FIG. 9 is a sectional view similar to FIG. 5, of a casing for use with the barbed retainer of FIG. 7.

When the female and male retainers 160,172 are inserted into the passageway 66 in FIG. 9, the casing 12, female and male retainers 160,172 appear as in FIG. 6 with the exception of the above-noted barbs.

The male and female retainers and the casing can be made of Delvin TM, a plastic manufactured by DuPont. Celcon TM, made by Celanese Plastics, can also be used. Polypropylene is also suitable. Suitable rivets include Dual Grip Fasteners manufactured by Precision Dynamics in San Fernando, Calif. The elongate strap can be formed with a Mylar TM inner layer and a vinyl outer layer. Such elongate straps are manufactured by Precision Dynamics. The upper and lower housings 16,20 can be formed from ABS plastic and fused together with ABS Plastic Adhesive manufactured by 3M (e.g., Scotch Grip 4475 Plastic Adhesive).

It can be appreciated that the above apparatus securely attaches the casing 12 to a person. Due to the construction of the apparatus 10, the casing 12 cannot be removed without damaging the apparatus 10. For example, the Mylar TM inner layer of the strip prevents the person from stretching the elongate strap to remove the strap without breaking the strap. Further, if the strap is cut, the braided wire 52 is broken and the circuit 38 can activate or deactivate a transmitter associated with the circuit 38. When the base station fails to receive a signal from the transmitter, the base station contacts the central station. Once the male and female retainers are inserted, they cannot be removed without damaging the apparatus 10.

The circuit 38 and batteries 40 may require pressure forcing them together to operate. Since the casing 12 is made of flexible plastic, the casing 12 (e.g., the wall 69) forms a spring 180 above the passageway 66 which biases the batteries against the circuit.

Other objects and advantages are readily apparent.

We claim:

1. Apparatus for securely attaching a casing to a person including:

an elongate strap;

a strap connector having a male retainer at an end thereof, and a female retainer at an opposite end thereof;

a casing defining first and second openings connected by a passageway;

first means on said casing and said female retainer for snap-fitting said female retainer in said passageway of said casing through sad first opening, wherein the female retainer includes a base and the first snap-fitting means on said female retainer includes first and second spaced cantilevered arms extending from said base, wherein sad first and second cantilevered arms each include an outwardly-facing projection at a distal end thereof; and second means on said male and female retainers for snap-fitting said male retainer to said female retainer in sad passageway through said second opening.

2. The apparatus of claim 1 wherein said elongate strap includes a first means for connecting said male retainer at the end and a second connecting means for connecting said female retainer at the opposite end.

3. The apparatus of claim 2 wherein said first connecting means lies inside said passageway when said female retainer is snap-fit to said casing.

4. The apparatus of claim 2 wherein said second connecting means lies inside said passageway when said male retainer is snap-fit to said female retainer.

5. The apparatus of claim 1 wherein said first snap-fitting means on said casing includes first and second C-shaped walls in said passageway and said casing includes a means for engaging said base when said female retainer is fully inserted.

6. The apparatus of claim 5 wherein said first and second C-shaped walls bias said first cantilevered arm towards said second cantilevered arm when said female retainer is inserted into said first opening, said first and second C-shaped walls releasing said first and second cantilevered arms as said base abuts said engaging means and wherein said C-shaped walls engage said first and second projections to prevent said female retainer from being removed from said casing.

7. The apparatus of claim 6 wherein said first and second projections include first and second barbs engaged, respectively, by first and second barbs in said first and second C-shaped walls when said female retainer is snap-fit in said casing to increase a pull-out resistance of said female retainer.

8. The apparatus of claim 6 wherein said second snap-fitting means on said female retainer includes a T-shaped recess defined by said base and said first and second cantilevered arms.

9. The apparatus of claim 8 wherein said male connector includes a base, and said second snap-fitting means on said male connector includes third and fourth cantilevered arms extending from said base and each having an outwardly-facing projection at distal ends thereof.

10. The apparatus of claim 9 wherein said second snap-fitting means on said female retainer further includes first and second inwardly-facing sides for slidingly receiving said projections on said third and fourth cantilevered arms and for biasing said third cantilevered arm towards said fourth cantilevered arm as said male connector is inserted into said second opening, said first and second inwardly-facing sides releasing said third and fourth cantilevered arms as said male connector is fully inserted into said passageway such that said third and fourth projections are fixedly engaged by said T-shaped recess in said female connector.

11. The apparatus of claim 1 wherein the casing includes upper and lower housings defining a chamber and wherein said passageway is formed in said lower housing.

12. The apparatus of claim 11 further including a circuit mounted in said chamber.

13. The apparatus of claim 12 further including a conductor embedded in said elongate strap and having an end extending from said male connector and an opposite end extending from said female connector, said conductor being connectable to said circuit when said male and female connectors are snap-fit in said passageway.

14. The apparatus of claim 11 wherein said upper housing is secured to said lower housing by threads.

15. The apparatus of claim 14 wherein a hole is drilled through said upper and lower housing and wherein glue is added to said hole.

16. The apparatus of claim 1 wherein said elongate strap includes an inner layer of Mylar TM and an outer layer of vinyl.

17. The apparatus of claim 1 wherein the elongate strap includes a plurality of spaced holes for adjusting elongate strap length.

18. Apparatus for securely attaching a casing to a person including:

a casing having first and second openings;

a strap; and a retainer at each end of the strap, each retainer having a base and flexible cantilevered arms extending from said base for insertion into one of said openings and snap-fit to said casing said cantilevered arms being inside said casing and inaccessible to manual manipulation to release the strap.

* * * * *